US006880623B2

(12) United States Patent
Gierlings

(10) Patent No.: US 6,880,623 B2
(45) Date of Patent: Apr. 19, 2005

(54) HEAT EXCHANGER FOR HEATING A PRODUCT, IN PARTICULAR A COMPOSITION FOR PRODUCING CANDIES

(75) Inventor: Johannes Gierlings, Schwalmtal (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/332,820

(22) PCT Filed: May 10, 2002

(86) PCT No.: PCT/DE02/01689

§ 371 (c)(1),
(2), (4) Date: Jun. 11, 2003

(87) PCT Pub. No.: WO02/093099

PCT Pub. Date: Nov. 21, 2002

(65) Prior Publication Data

US 2004/0089441 A1 May 13, 2004

(30) Foreign Application Priority Data

May 12, 2001 (DE) ..... 101 23 219

(51) Int. Cl.[7] ..... F28D 7/10

(52) U.S. Cl. ..... 165/100; 165/159; 165/102; 165/145

(58) Field of Search ..... 165/102, 100, 165/145, 157, 161, 163, 159

(56) References Cited

U.S. PATENT DOCUMENTS 3,209,819 A 10/1965 LeClercq
3,612,002 A 10/1971 Margittai
3,907,028 A 9/1975 Lawson
5,820,655 A * 10/1998 Gottzmann et al. ..... 95/54
5,915,465 A * 6/1999 Fix et al. ..... 165/103
6,139,810 A * 10/2000 Gottzmann et al. ..... 422/197
6,426,054 B1 * 7/2002 Filippi et al. ..... 422/201
6,536,513 B1 * 3/2003 Font-Freide et al. ..... 165/159

FOREIGN PATENT DOCUMENTS

DE 29 07 770 1/1980
DE 44 02 466 A1 8/1995
FR 973 724 2/1951
FR 1 330 305 6/1963

* cited by examiner

*Primary Examiner*—Terrell McKinnon
(74) *Attorney, Agent, or Firm*—Ronald E. Greigg

(57) ABSTRACT

A heat exchanger comprises a housing jacket and tube segments disposed concentrically inside the housing jacket. Between two receiving plates, closing the housing jacket on its face ends, the tube segments embody heating chambers and product chambers. While the product to be heated flows in a meandering course through the heat exchanger, the heating medium flows through the heat exchanger over short paths from a medium inlet stub, in the direction of a medium outlet stub. The heat exchanger of the invention is distinguished by a relatively simple construction and is especially suitable for compositions in the candy industry, using steam as the heating medium.

17 Claims, 2 Drawing Sheets

HEAT EXCHANGER FOR HEATING A PRODUCT, IN PARTICULAR A COMPOSITION FOR PRODUCING CANDIES

CROSS-REFERENCE TO RELATED APPLICATIONS

This application is a 35 USC 371 application of PCT/DE 02/01689 filed on May 10, 2002.

BACKGROUND OF THE INVENTION

1. Field of the Invention

The invention relates to an improved heat exchanger for heating a product, in particular a composition for producing candies.

2. Description of the Prior Art

One heat exchanger of the type with which this invention is concerned is known from U.S. Pat. No. 5,246,062. In this known heat exchanger, the product is guided within parallel tubes of equal diameter disposed side by side. In the face-end closing elements of the housing jacket of the heat exchanger there are recesses, which together with the tubes form a meandering product path. The inlet for the heating medium is located in the upper part of the cylindrically embodied housing jacket, while the outlet is disposed in the lower part. A disadvantage of the known heat exchanger is that no defined flow path within the housing is created for the heating medium. Instead, the tubes that carry the product protrude transversely into the flow path of the heating medium, so that the heat transfer from the heating medium into the product, and hence the efficiency of the known heat exchanger, are not yet optimal. This is also due to idle spaces, through which heating medium flows only inadequately. Furthermore, a product when it is heated expands inside the tubes. Since the tube diameter for the product is always the same in the known heat exchanger, the pressure of the product thus increases steadily upon heating along the product path, which can lead to a shift in the boiling line of the product and to strength problems and necessitates appropriate dimensioning of the tubes.

From German Patent DE 29 07 770 C2, a heat exchanger is also known in which both the product and the heating medium are carried back and forth in a meandering course. However, a disadvantage here, among others, is its relatively complicated structure because of the various meandering flow paths.

SUMMARY OF THE INVENTION

The heat exchanger of the invention for heating a product, in particular a composition for producing candies, has the advantage over the prior art that because of defined flow paths for the heating medium, it has relatively high efficiency. Moreover, because of widening product path cross sections, it makes relatively little demand in terms of strength and counteracts the shift in the boiling line caused by an otherwise increasing pressure of the product. Finally, it is also structurally relatively simple.

If the chambers of annular cross section for the heating medium are closed off with annular closure plates, which in turn communicate with the receiving plates via tubes, then the meandering course for the product can be realized in a structurally simple way.

BRIEF DESCRIPTION OF THE DRAWINGS

One exemplary embodiment of the invention is described in further detail below, with reference to the drawings, in which.

DESCRIPTION OF THE PREFERRED EMBODIMENTS

Figure 1:
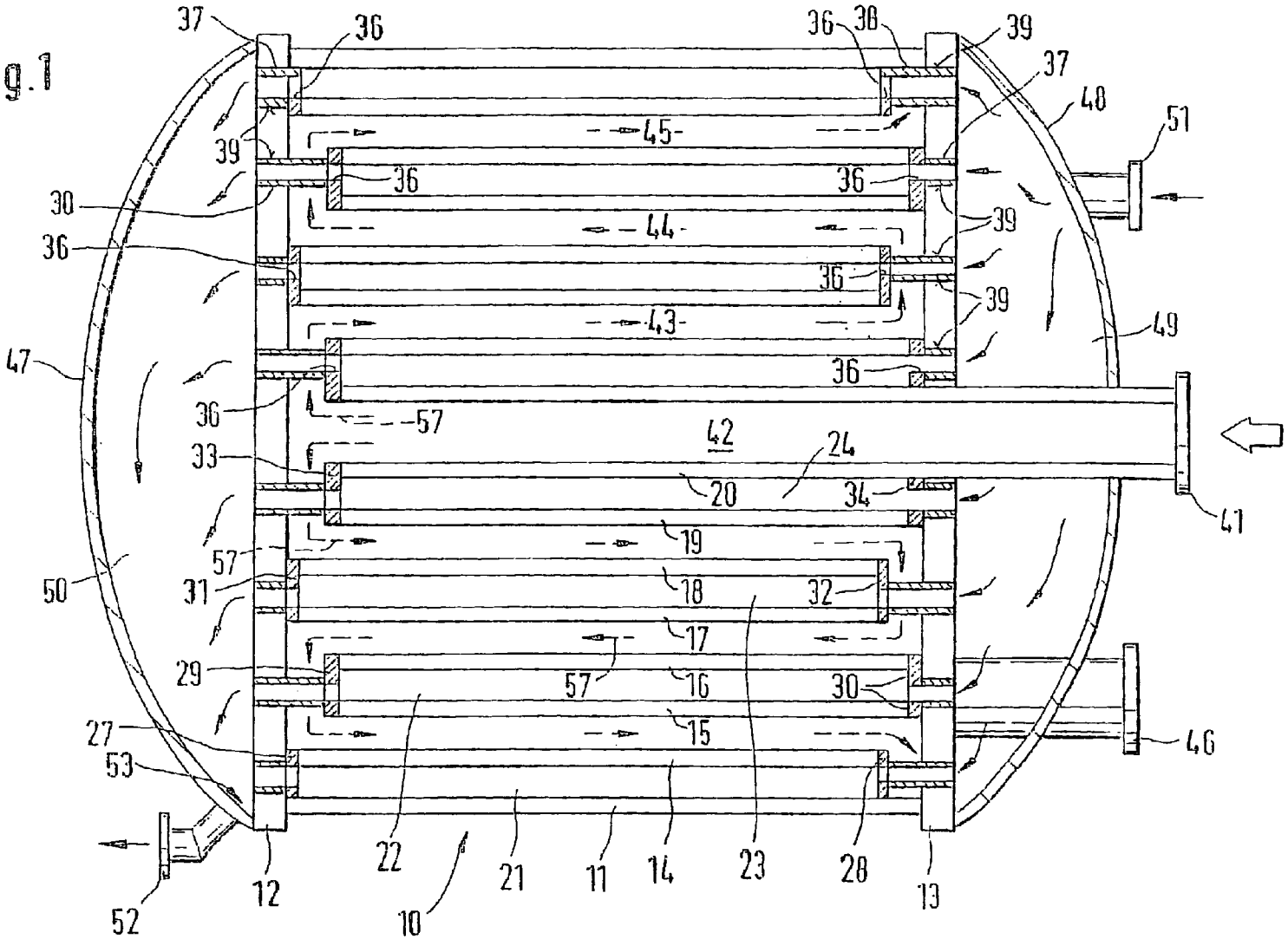
FIG. 1 is a heat exchanger of the invention in a simplified longitudinal section.

The heat exchanger 10 shown in the drawings preferably serves to heat a composition for producing candies, such as a solution of sugar and glucose syrup, using steam as the heating medium. The heat exchanger 10 has an outer, preferably cylindrical or tubular housing jacket 11. On each of the face ends of the housing jacket 11 there is a respective receiving plate 12, 13, which completely covers the respective face end of the housing jacket 11 and is solidly joined to the housing jacket 11.

Tube segments 14–20, each of different diameters, are each disposed concentrically to one another inside the housing jacket 11. The housing jacket 11 together with the tube segment 14 forms a first heating chamber 21; the two tube segments 15, 16 form a second heating chamber 22; the two tube segments 17, 18 form a third heating chamber 23; and the two tube segments 19, 20 form a fourth heating chamber 24, the heating chambers 21–24 each being annular in cross section. The heating chambers 21–24 are bounded on their face ends by circular-annular closure rings or plates 27–34. In the closure plates 27–34, there are bores 36 that are aligned with tube segments 37, 38 that are disposed on the side of the closure plates 27–34 remote from the heating chambers 21–24 and that protrude sealingly into corresponding bores 39 in the receiving plates 12, 13. On the side remote from the heating chambers 21–24, the tube segments 37, 38 are flush with the end faces of the receiving plates 12, 13.

Figure 2:
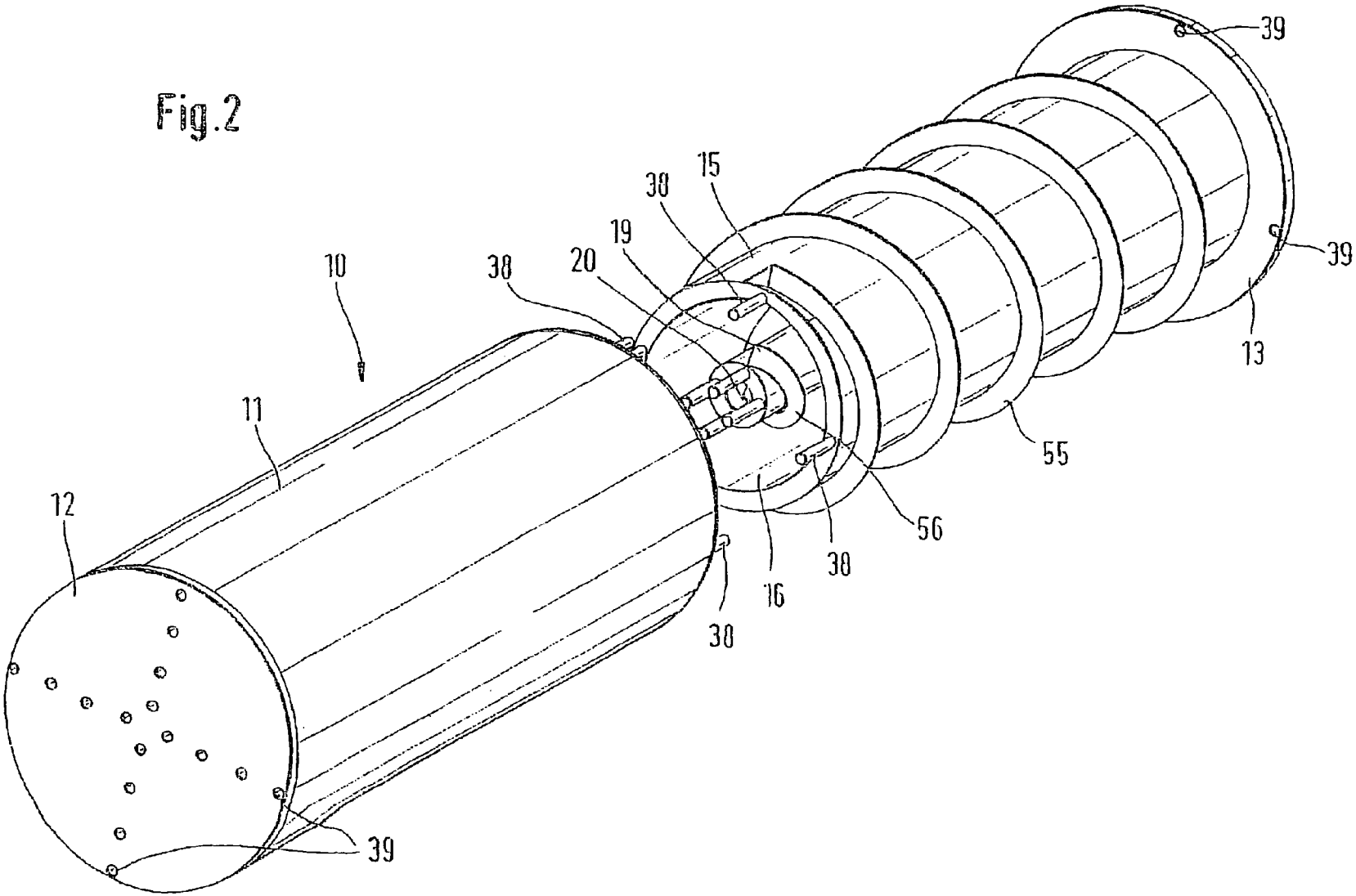
FIG. 2, a heat exchanger that is modified compared to FIG. 1, shown in an exploded view, with the face-end closure caps and several tube segments that embody the heating and product chambers left out.

In the exemplary embodiment, four tube segments 37, 38 disposed at regular angular intervals from one another, as can be seen particularly from FIG. 2, are connected to each of the closure plates 27–34. To avoid idle spaces for the steam and to carry away the cooled, condensed steam, the arrangement of tube segments 37, 38 is selected such that at least one tube segment 37, 38 each is disposed in both the upper region and the lower region of the heat exchanger 10.

It is also essential that each of the heating chambers 21–24 be coupled with respective short tube segments 37 on one side and respective long tube segments 38 on the opposite side. Moreover, the spacing between two closure plates 27–34, facing one another, of a given heating chamber 21–24 is less than the spacing of the two receiving plates 12, 13 from one another. Moreover, the closure plates 27, 30, 31 and 34 communicating with the short tube segments 37 rest directly on the respective receiving plate 12, 13 oriented toward it, while the closure plates 28, 29, 32 and 33 communicating with the long tube segments 38 are spaced apart from the respective receiving plate 12, 13 oriented toward them.

The tube segment 20, disposed centrally in the housing jacket 11 and communicating on one side with the closure plate 33, penetrates the receiving plate 13 in a corresponding bore, and on the side opposite the closure plate 33, it forms an inlet stub 41, through which the composition to be heated enters the heat exchanger 10. The interior of the tube segment 20 forms a first product chamber 42. Other product chambers 43, 44 and 45, each embodied annularly in cross section and disposed concentrically to one another, are located between the receiving plates 12, 13 and are defined by the tube segments 14–19. The outermost product chamber 45 communicates with an outlet stub 46, through which the composition to be heated emerges from the heat exchanger 10. The communication with one another of the individual product chambers 42–45, which as already explained are disposed concentrically to one another, is effected via the regions between the closure plates 28, 29, 32 and 33 and the respective receiving plates 12, 13 spaced apart from them. In these overflow regions between the individual product chambers 42–45, only the long tube segments 38 are disposed, which only insignificantly impede any overflow of the composition from one product chamber 42–44 into the other product chamber 43–45.

The receiving plates 12, 13 are covered completely, each by a respective convex closure cap 47, 48, on the side remote from the heating chambers 21–24. One closure cap 48, together with the receiving plate 13, defines an entrance chamber 49 for the heating medium, in particular steam, while the other closure cap 47 together with the receiving plate 12 defines an exit chamber 50. While the inlet stub 41 and the outlet stub 46 penetrate the closure cap 48 without being in contact with the entrance chamber 49, a medium inlet stub 51 communicates with the closure cap 48 and discharges into the entrance chamber 49. At the bottom of the closure cap 47, there is also a medium outlet stub 52, which communicates with the exit chamber 50.

In FIG. 2, the heat exchanger 10 just described is shown in an exploded view to illustrate its structure. In FIG. 2, for the sake of greater clarity, however, the closure caps 47, 48 and tube segments 17, 18 (which are located in the housing jacket 11 and are connected to the receiving plate 12) have not be shown. It can also be seen that compared to the heat exchanger of FIG. 1, in addition a helically embodied product guide baffle 55 is disposed on the outer circumference of the tube segment 15. A further product guide baffle 56 is disposed on the outer circumference of the tube segment 19. These product guide baffles 55, 56 are preferably disposed over the entire length of the corresponding product chamber 43–45 and also over the entire cross section of the applicable product chamber. With the product guide baffles 55, 56, it is attained that the composition to be heated inside the applicable product chamber 43–45 does not flow over the shortest path from the inlet to the corresponding outlet but instead is guided helically along the corresponding product guide baffle 55, 56, so that the flow path of the product or composition is lengthened and thus the flow time is also increased.

Moreover, although not shown, so-called mixing bodies may be disposed inside the product chambers 42–45. These mixing bodies, which are already well known, are stationary bodies that serve to improve the mixing of the composition to be heated.

The heat exchanger 10 of the invention functions as follows: From a steam generator, not shown, the heating medium (steam) that is under pressure flows via the medium inlet stub 51 into the entrance chamber 49, where it is distributed uniformly. Over the short tube segments 37 and the long tube segments 38, the steam reaches the heating chambers 21–24, in which the steam flows in the direction of the receiving plate 12. The steam then leaves the heating chambers 21–24 via the short tube segments 37 and the long tube segments 38 to enter the exit chamber 50. If after flowing through the heating chambers 21–24 the steam has been cooled below its condensation temperature, then the steam emerges as condensate in liquid form from the outlet stub 52. Thus what is essential in terms of the flow course of the steam or heating medium is that the steam flow rectilinearly and thus in guided fashion through the heat exchanger 10 from the direction of one receiving plate 13 in the direction of the other receiving plate 12. By comparison, the composition to be heated enters the heat exchanger 10 via the inlet stub 41 and the first product chamber 42. From there, the composition to be heated flows radially outward via the closure plate 33 into the second product chamber 43. In the second product chamber 43, the composition to be heated flows back in the direction of the receiving plate 13, where it flows radially outward via the closure plate 32 to enter the third product chamber 44. In the product chamber 44, the composition flows back in the direction of the receiving plate 12 again, where via the closure plate 29 it flows radially outward into the fourth product chamber 45. From the fourth product chamber 45, finally, the composition flows back in the direction of the receiving plate 13, from where it flows through at least one corresponding opening into the outlet stub 46 and then out of the heat exchanger 10. To illustrate the above-described meandering flow path of the product and of the composition to be heated, flow arrows 57 are shown in FIG. 1, which are meant to illustrate the course of the product through the heat exchanger 10. If product guide baffles 55, 56 are present, then the product to be heated, as already described, does not flow inside the heat exchanger 10 over the direct course inside the product chambers 42–45, but rather over helical courses. While the composition to be heated is flowing through the heat exchanger 10, its temperature increases as desired, because a heat transfer takes place from the steam, flowing through the heat exchanger 10 in the heating chambers 21–24, into the product chambers 42–45. It is understood that this heat transfer can be varied by means of a suitable choice of material or the thickness of the individual tube segments 14–20. Moreover, the heat transfer is dependent on the throughput quantity of the steam and on the length of the heating chambers 21–24, the number of product chambers 42–45, and the flow quantity of the product to be heated.

The heat exchanger 10 described above can be structurally modified in manifold ways. For instance, it is conceivable for the individual heating chambers 21–24 to be provided with separate medium inlet stubs, by way of which the heating medium can be carried into the heat exchanger 10 at different temperatures or pressures or with different flow directions. Moreover, a widening or narrowing cross-sectional course may be provided for both the heating chambers 21–24 and the product chambers 42–45. The number of heating chambers 21–24 and product chambers 42–45 can also be different from what is shown and described here for the exemplary embodiment. Finally, it is also conceivable to provide a plurality of outlet stubs 46 for the product, which can optionally communicate with different product chambers 42–45 and by suitable connection can create product paths of various lengths. From a production standpoint, the heat exchanger 10 can be embodied either as a welded construction or as a construction that can be dismantled, with suitable screw connections and sealing connections.

The foregoing relates to preferred exemplary embodiments of the invention, it being understood that other variants and embodiments thereof are possible within the spirit and scope of the invention, the latter being defined by the appended claims.

What is claimed is:

1. A heat exchanger (10) for heating a product, in particular a composition for producing candies, comprising a preferably cylindrically embodied housing jacket (11), receiving plates (12, 13), disposed on the face ends of the housing jacket (11), in which plates tubes (14–20) for a medium that extend inside the housing jacket (11) parallel to one another are supported, closure caps (47, 48) covering the receiving plates (12, 13) on the side opposite the tubes (14–20), an inlet (51) and an outlet (52) for a heating medium as well as an inlet (41) and an outlet (46) for the product to be heated, means guiding the product in a meandering course in order to lengthen the action time of the heating medium, the tubes (14–20) having different diameters and being disposed concentrically to one another;

one chamber (21–24) of annular cross section for the heating medium being embodied by each pair of tubes (14, 20) adjacent to one another and by the outer tube and the housing jacket (11); and inlet means for introducing the heating medium into the annular chambers (21–24) in the region of one receiving plate (13) and outlet means for carrying the heating medium out of the annular chambers (21–24) in the region of the other receiving plate (12), the heating medium flowing rectilinearly through the annular chamber (21–24) from the direction of one receiving plate (13) in the direction of the other receiving plate (12) and then being carried directly out, wherein the tube pairs (14–20), forming the annular chambers (21–24) for the heating medium are each closed on their face ends by a respective closure ring (27–34); wherein the length of the tubes (14–20) plus the closure rings (27–34) is less than the spacing of the two receiving plates (12, 13) from one another; wherein communicating with each closure ring (27–34) is at least one inlet and outlet tube (37, 38) for the heating medium; wherein the inlet and outlet tubes (37, 38) are supported sealingly in the receiving plates (12, 13); and wherein closure rings (27–34) radially adjacent with respect to a receiving plate (12, 13) alternatively contact the applicable receiving plate (12, 13) or are spaced apart from them, to form the meandering product course.

2. The heat exchanger of claim 1, wherein communicating with each closure ring (27–34) are a plurality of inlet and outlet tubes (37, 38), preferably four of them; and wherein the inlet and outlet tubes (37, 38) are each disposed at equal angular intervals from one another.

3. The heat exchanger of claim 1, wherein the inlet (41) for the product is disposed centrally relative to the receiving plates (12, 13) and inside the housing jacket (11) embodies a first chamber (42) for the product; and wherein the product from the first chamber (42) enters the first annular chamber (43) radially and from there passes over, also radially, into the ensuing annular chambers (44, 45), so that the outlet (46) for the product is coupled with the radially outermost annular chamber (45).

4. The heat exchange of claim 2, wherein the inlet (41) for the product is disposed centrally relative to the receiving plates (12, 13) and inside the housing jacket (11) embodies a first chamber (42) for the product; and wherein the product from the first chamber (42) enters the first annular chamber (43) radially and from there passes over, also radially, into the ensuing annular chambers (44, 45), so that the outlet (46) for the product is coupled with the radially outermost annular chamber (45).

5. The heat exchanger of claim 1, wherein the closure caps (47, 48) that cover the receiving plates (12, 13) are embodied convexly, so that an entrance chamber (49) and an exit chamber (50) for the heating medium are formed between the closure caps (47, 48) and the receiving plates (12, 13).

6. The heat exchanger of claim 2, wherein the closure caps (47, 48) that cover the receiving plates (12, 13) are embodied convexly, so that an entrance chamber (49) and an exit chamber (50) for the heating medium are formed between the closure caps (47, 48) and the receiving plates (12, 13).

7. The heat exchanger of claim 5, wherein the inlet (51) and the outlet (52) for the heating medium are disposed on the opposed closure caps (48, 49); and wherein the outlet (52) is disposed on the bottom (53) of the exit chamber (50).

8. The heat exchanger of claim 1, wherein mixing or guide elements (55, 56) are disposed in stationary fashion in the product path.

9. The heat exchanger of claim 2, wherein mixing or guide elements (55, 56) are disposed in stationary fashion in the product path.

10. The heat exchanger of claim 3, wherein mixing or guide elements (55, 56) are disposed in stationary fashion in the product path.

11. The heat exchanger of claim 4, wherein mixing or guide elements (55, 56) are disposed in stationary fashion in the product path.

12. The heat exchanger of claim 8, wherein the guide elements (55, 56) are embodied helically and preferably extend over the entire length of the tubes (14–20) that are disposed concentrically to one another and also extend radially the full distance between two adjacent tubes (14–20) to form helical product paths.

13. A heat exchanger (10) for heating a product, in particular a composition for producing candies, comprising a preferably cylindrically embodied housing jacket (11), receiving plates (12, 13), disposed on the face ends of the housing jacket (11), in which plates tubes (14–20) for a medium that extend inside the housing jacket (11) parallel to one another are supported, closure caps (47, 48) covering the receiving plates (12, 13) on the side opposite the tubes (14–20), an inlet (51) and an outlet (52) for a heating medium as well as an inlet (41) and an outlet (46) for the product to be heated, means guiding the product in a meandering course in order to lengthen the action time of the heating medium, the tubes (14–20) having different diameters and being disposed concentrically to one another;

one chamber (21–24) of annular cross section for the heating medium being embodied by each pair of tubes (14, 20) adjacent to one another and by the outer tube and the housing jacket (11); and inlet means for introducing the heating medium into the annular chambers (21–24) in the region of one receiving plate (13) and outlet means for carrying the heating medium out of the annular chambers (21–24) in the region of the other receiving plate (12), the heating medium flowing rectilinearly through the annular chamber (21–24) from the direction of one receiving plate (13) in the direction of the other receiving plate (12) and then being carrier directly out, wherein the inlet (41) for the product is disposed centrally relative to the receiving plates (12, 13) and inside the housing jacket (11) embodies a first chamber (42) for the product; and wherein the product from the first chamber (42) enters the first annular chamber (43) radially and from there passes over, also radially, into the ensuing annular chambers (44, 45), so that the outlet (46) for the product is coupled with the radially outermost annular chamber (45).

14. The heat exchanger of claim 13, wherein the closure caps (47, 48) that cover the receiving plates (12, 13) are embodied convexly, so that an entrance chamber (49) and an exit chamber (50) for the heating medium are formed between the closure caps (47, 48) and the receiving plates (12, 13).

15. The heat exchanger of claim 13, wherein mixing or guide elements (55, 56) are disposed in stationary fashion in the product path.

16. The heat exchanger of claim 14, wherein the inlet (51) and the outlet (52) for the heating medium are disposed on the opposed closure caps (48, 49); and wherein the outlet (52) is disposed on the bottom (53) of the exit chamber (50).

17. The heat exchanger of claim 15, wherein the guide elements (55, 56) are embodied helically and preferably extend over the entire length of the tubes (14–20) that are disposed concentrically to one another and also extend radially the full distance between two adjacent tubes (14–20) to form helical product paths.

* * * * *